United States Patent [19]

Rodgers

[11] 4,066,087

[45] Jan. 3, 1978

[54] PEA SHELLING APPARATUS

[75] Inventor: Rolza J. Rodgers, Centerville, Ga.

[73] Assignee: Ross Agricultural Company, Inc., Tuscaloosa, Ala.

[21] Appl. No.: 642,745

[22] Filed: Dec. 22, 1975

[51] Int. Cl.[2] ..... B02B 3/08

[52] U.S. Cl. ..... 130/30 H; 99/605

[58] Field of Search ..... 130/30 H, 30 R; 209/390, 385, 386, 389; 99/629, 630, 574, 603, 604, 605, 606, 607, 608, 617

[56] References Cited

U.S. PATENT DOCUMENTS

| | | | |
|---|---|---|---|
| 457,538 | 8/1891 | Moulton | 130/30 H |
| 527,954 | 10/1894 | Empson | 130/30 H |
| 546,095 | 9/1895 | Empson | 130/30 H |
| 1,202,486 | 10/1916 | Coil | 130/30 H |
| 2,329,910 | 9/1943 | Johnson | 99/605 X |
| 2,543,537 | 2/1951 | Smith | 130/30 H |
| 2,633,852 | 4/1953 | Lupton | 130/30 H |

*Primary Examiner*—Jay N. Eskovitz

*Attorney, Agent, or Firm*—Frederick L. Bergert

[57] ABSTRACT

A device for shelling peas, beans, and the like. The device comprises a rotating drum having a plurality of paddles mounted therein on a rotating shaft which extends axially through the drum. The paddles each have a flat striking surface which extends for substantially the entire length thereof and which is oriented to be parallel to the longitudinal axis of the rotating shaft. A cover surrounds the drum and forms a chute for guiding kernels separated from the shells in the drum onto an inclined trough which guides those kernels to a collection location. The drum and the paddles both rotate in the same direction at prescribed velocities.

14 Claims, 6 Drawing Figures

PEA SHELLING APPARATUS

BACKGROUND OF THE INVENTION

The present invention relates to agricultural threshing, and more particularly, to the shelling of vegetables such as beans and peas.

Because hand shelling is tedious and time consuming, faster and better methods of shelling green peas, beans and leguminous vegetables are constantly being sought. Many devices have been proposed. However, these devices often produce extensive damage to the peas or beans during the shelling operation, and some of the devices produce sufficient damage to result in the loss of as much as forty to sixty percent of the vegetables. Such high losses reduce profits, and are wasteful of valuable crops. Therefore, there is need of a device which can perform the shelling operation efficiently and with only minimal loss of the crop through damage during that shelling operation.

Many known devices utilize rotating drums as shelling chambers and have impellers or paddles positioned therein to perform the shelling operation. For example, some devices have small bars extending radially outward from rotating drive shafts which are positioned axially within the drums. The bars support variously shaped impellers which serve as the threshing devices, or striking instruments. However, the impellers of these devices often have sharp edges or corners which may strike the pods and often these impellers each present only a limited amount of flat surface area for performing the actual striking operation. The corners or edges can cause great damage to kernels removed from the pods by breaking or bruising those kernels. Because of the small striking surfaces, these devices require the material to remain in the shelling chamber for great lengths of time to remove all the kernels from the pods. The possibility of damage to the kernels increases as the time they spend in the shelling chamber increases.

Another known device utilizes impellers which have striking surfaces oriented at an angle with respect to the longitudinal axis of the rotating shaft to which they are attached. Such a device delivers glancing blows to the material to cause the refuse to move through the shelling chamber in a longitudinal direction. This device also requires a great deal of time to complete a threshing operation and also has exposed sharp edges which may damage the kernels during the shelling operation. Consequently, the loss percentage with this device is also very high.

The device of the present invention has paddles designed to maximize the amount of flat striking surface and which rotate at a prescribed velocity with respect to a rotating cylinder.

SUMMARY OF THE INVENTION

The device embodying the present invention quickly shells material, such as beans, peas and the like with only an insignificant amount of damage to the kernels.

The device comprises a horizontal rotating drum which serves as a shelling chamber and has a plurality of wood paddles mounted on a rotating shaft which extends axially within the rotating drum and rotates at a prescribed velocity. The drum rotates at a prescribed velocity and includes a foraminous screen having holes therein which are sized and shaped to pass kernels therethrough while retaining hulls, and other waste material in the drum. A cover surrounds the drum to prevent material from escaping the device, and the rotational velocities of the shaft and the drum are selected to prevent undue mutilation of the kernels.

The paddles each present a large flat striking surface which is oriented to be essentially parallel with the longitudinal axis of the rotating shaft and which extends for essentially the entire length of each paddle. The flat striking surface effects a quick and gentle removal of a kernel from a hull, and slightly rounded corners and edges on the paddles help to prevent damage to the kernels.

Located subadjacent the drum is an inclined trough formed of a foraminous screen mounted on a frame and having a chute opening located superadjacent a collection means for the kernels. The cover has formed thereon a pair of downwardly extending wings which are inclined toward each other to form a chute beneath the drum for guiding kernels into the inclined trough. After shelling, the kernels pass from the drum, through the screen thereon, and into the chute formed by the cover where they are guided to the inclined trough which, in turn, guides those kernels to the collection means.

The device of the present invention is simple to operate, and requires virtually no maintenance or upkeep. The cleaning thereof is expeditious and can be performed shortly after use, (as quickly as 3 to 4 minutes after use). The device is also essentially bacteria-free due to the non-porous nature of the materials used, and any cleaning required is very simply effected. The screening of trash or foreign matter from peas or beans by a shaker screen in the bottom of the device results in a clean product, and the kernels are ejected quickly and in a clean state ready for nearly immediate table use.

The device embodying the present invention delivers a high percentage of undamaged peas and beans from a given amount of gross vegetables in the hull or shell. The percentage of undamaged vegetables delivered by the device embodying the present invention very nearly approaches that percentage which can be delivered by hand shelling.

OBJECTS OF THE INVENTION

It is therefore a main object of the present invention to deliver a high percentage of undamaged kernels from a given amount of gross material.

It is another object of the present invention to deliver a high percentage of undamaged kernels from a given amount of gross material in a short period of time.

It is a more specific object of the present invention to remove kernels from shells of vegetables with a device which delivers quick yet gentle blows to the shelled vegetables in order to separate the kernel from the pod.

These together with other objects and advantages which will become subsequently apparent reside in the details of construction and operation as more fully hereinafter described and claimed, reference being had to the accompanying drawings forming part hereof, wherein like numerals refer to like parts throughout.

DETAILED DESCRIPTION OF THE PREFERRED EMBODIMENT

Figure 1:
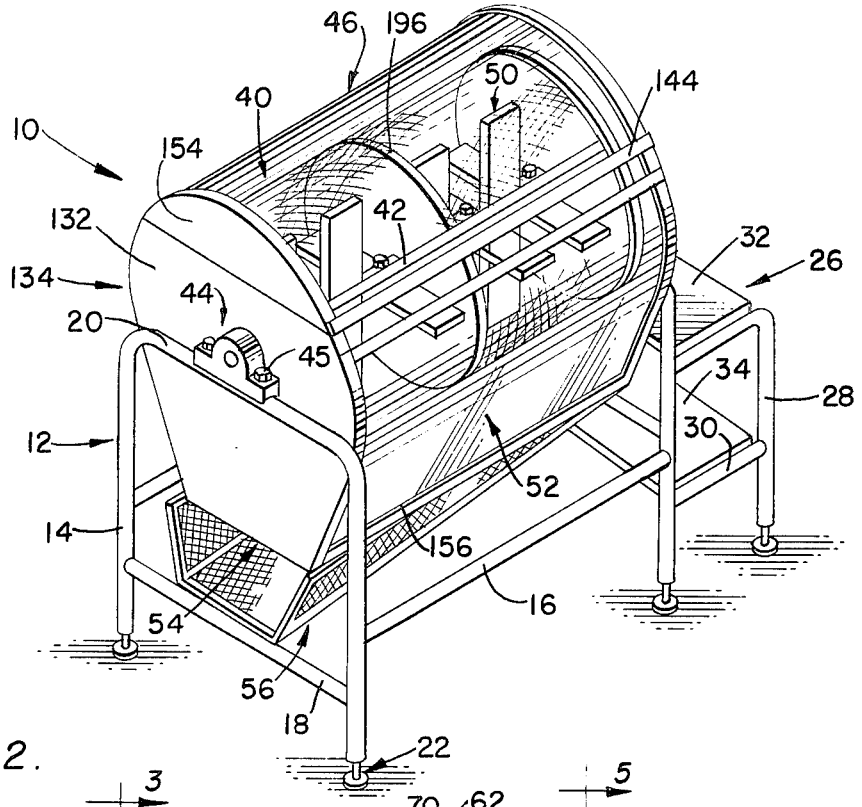
FIG. 1 is a perspective view of the device embodying the present invention.

As shown in the drawings, a shelling device 10 is mounted on a frame 12 comprising a plurality of legs 14 interconnected by a plurality of longitudinal cross braces 16 and transverse cross braces 18. A pair of transverse frame top elements 20 interconnect the tops of the legs 14, and a plurality of adjustable feet 22 are located on the bottoms of the legs for adjusting the height and horizontal orientation of the device. Affixed at one end of the device is an extension 26 having legs 28 interconnected by longitudinal cross braces 30 which have connected thereto by suitable fastening means an upper shelf 32 and a lower shelf 34 upon which a driving means 36 is supported.

A rotating drum 40 is rotatably mounted on frame top elements 20 by a shaft 42 which extends axially therethrough and is rotatably mounted on elements 20 by keeper means 44 which are suitably fastened to each of the elements 20 by fastening means, such as bolts 45. The rotating drum 40 is horizontally oriented and is located within a cover means 46 which is also attached to the shaft 42 to enable the drum 40 to rotate therewithin. A plurality of paddles 50 are connected by suitable fastening means to the shaft 42 for rotation therewith so that the paddles extend radially outward therefrom.

The cover means 46 has two downwardly extending sides 52 which are inclined toward each other and toward the vertical plane containing shaft 42. The sides 52 form an outlet chute 54 located subadjacent rotating drum 40 for guiding kernels passing from the drum onto an inclined trough 56 which guides those kernels to a suitable collecting means 58 for collection and temporary storage.

Figure 2:
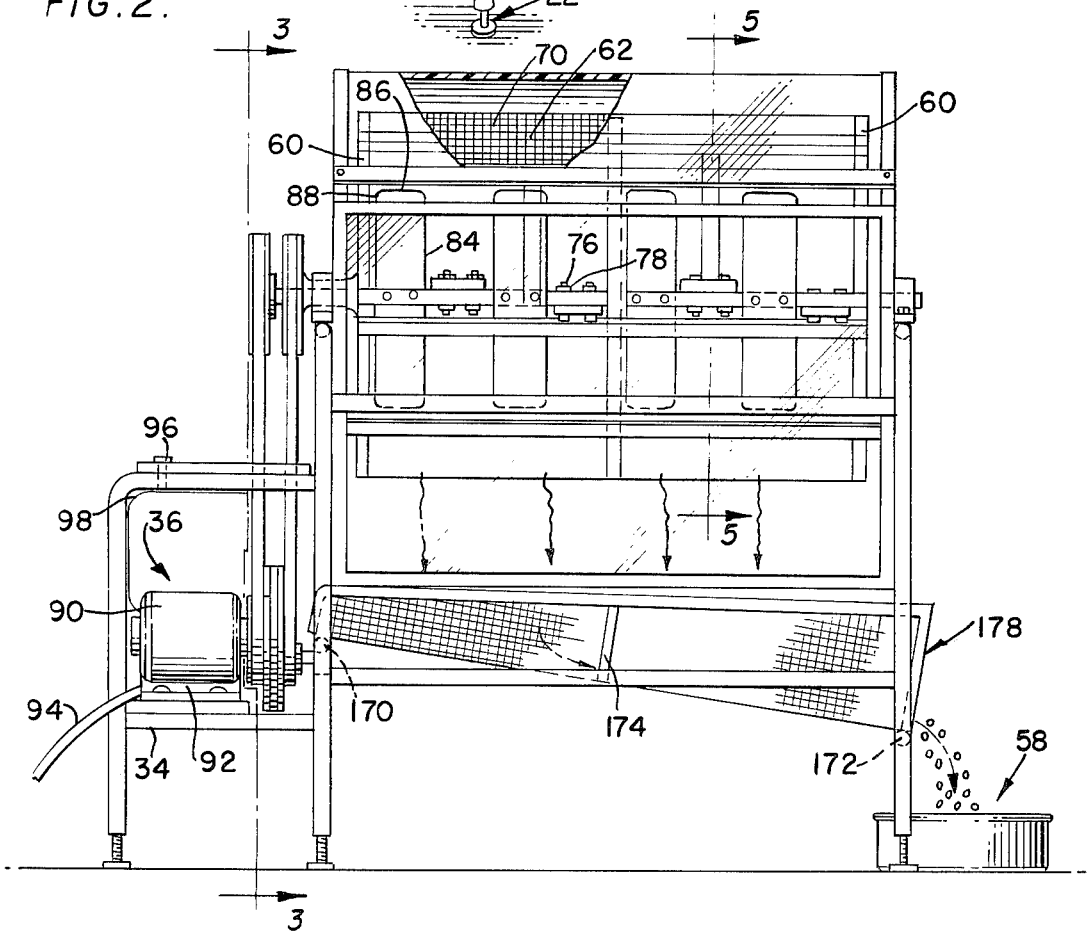
FIG. 2 is a partially cut-away side elevation of the device embodying the present invention.

As shown in FIG. 2, the rotating drum 40 comprises a pair of opposite end pieces 60 having a foraminous screen 62 extending therebetween and connected thereto at its opposite ends by suitable fastening means. The screen 62 has a door 64 (FIG. 5) for inserting material to be shelled into the drum. The door 64 comprises a pair of longitudinally oriented support struts 66 and circumferential support ribs all of which serve to stiffen and strengthen the screen 62 as well as to admit material into the drum.

The screen 62 is comprised of a multiplicity of holes 70 which are arranged and sized to pass kernels of the appropriate size therethrough while retaining within drum 40 shells and other waste matter. As will be later discussed, the drum is suitably connected to the drive means for rotation about the central axis of the drum which axis coincides with the longitudinal axis of shaft 42. The drum is suitably supported in the horizontal orientation by shaft 42.

Figure 5:
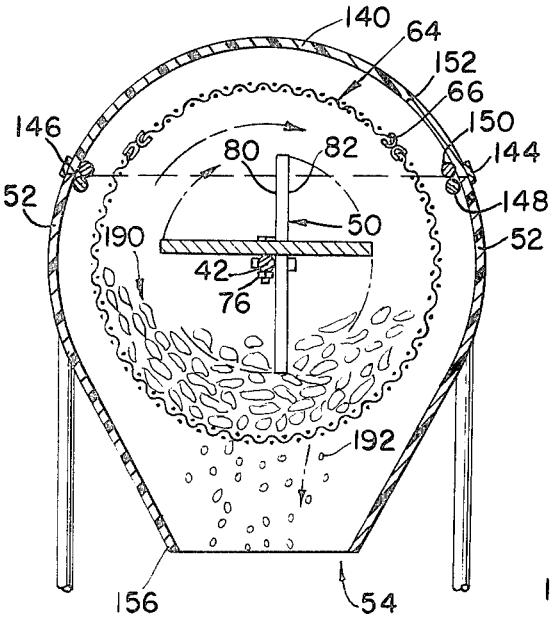
FIG. 5 is a sectional view taken along line 5—5 of FIG. 2.

As shown in FIGS. 2 and 5, the paddles 50 are secured to shaft 42 by suitable means such as hex cap bolts 76 and washers 78. The paddles extend radially outward from shaft 42 and are connected thereto so that flat striking surfaces 80 and 82 are oriented to be essentially parallel to the longitudinal axis of the shaft 42. As shown in FIG. 5, the paddles are each connected to the shaft at, or near, their mid-points so that the device is dynamically stable. As shown in FIG. 2, the paddles each have gently rounded longitudinal side edges 84 and gently rounded transverse ends 86 interconnected by rounded corners 88 and which, themselves, are gently rounded. The gentle rounding is into the plane of the paper for the paddle position shown in FIG. 2. The flat striking surfaces 80 and 82 extend for essentially the entire length of each of the paddles as do the essentially parallel longitudinal edges 84. Likewise, the flat surfaces extend for essentially the entire width of the paddles as do the essentially parallel transverse ends 86. As shown in FIG. 5, adjacent paddles are oriented to be perpendicular with respect to each other in the preferred embodiment.

The essentially flat striking surfaces of the paddles, coupled with the gently rounded corners and edges thereof, cooperate to strike the shelled kernels in such a manner as to free the kernels from the shells without damaging the kernels themselves while effecting a shelling operation which is very rapid as compared to the shelling operation of known devices.

In the preferred embodiment, the paddles have a longitudinal length less then the inner diameter of rotating drum 40 so that there is a clearance space between ends 86 and the inner surface of the rotating drum 40. Preferably, the drum has an inner diameter of 23 inches and is 36 inches long, and the paddles are made of a solid wood and are 3½ inches wide by 14½ inches long. However, the dimensions and overall sizes of the device can be adjusted according to the needs of a particular user. Thus, the full extremity of each of the paddles is utilized to make the maximum flat striking surface available for performing the shelling operation. The paddles preferably are pine or spruce wood which is soft enough to prevent damage to the kernels, yet hard enough to effect the shelling operation. However, other materials having similar properties may be used.

As shown in FIG. 2, driving means 36 comprises a pair of motors 90 mounted by motor mounts 92 to lower shelf 34. The motors may be electric motors with power cords 94 and suitable off-on switch 96 mounted on upper shelf 32 and connected to the motors via cable 98. Only one motor is shown for the sake of clarity, however it is to be understood that there are a pair of motors in the preferred embodiment.

Figure 3:
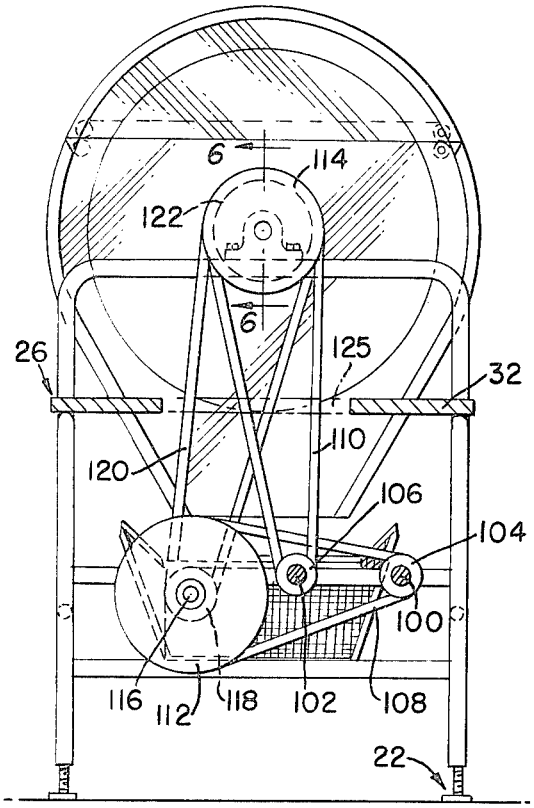
FIG. 3 is an end view taken along line 3—3 of FIG. 2 showing one end of the device embodying the present invention.

As shown in FIG. 3, drive shafts 100 and 102 of the motors drive suitable drive pulleys 104 and 106 respectively, around which are trained belts 108 and 110 respectively and which are also trained around pulleys 112 and 114 respectively. Pulley 112 is fixedly secured to a shaft 116 to which is fixedly secured a drive pulley 118 immediately adjacent pulley 112. Trained around pulley 118 is a belt 120 which is also trained around a pulley 122 located immediately adjacent pulley 114 on extension 124 of shaft 42. As shown, belts 110 and 120 extend upwardly through a hole 125 defined in upper shelf 32.

Figure 6:
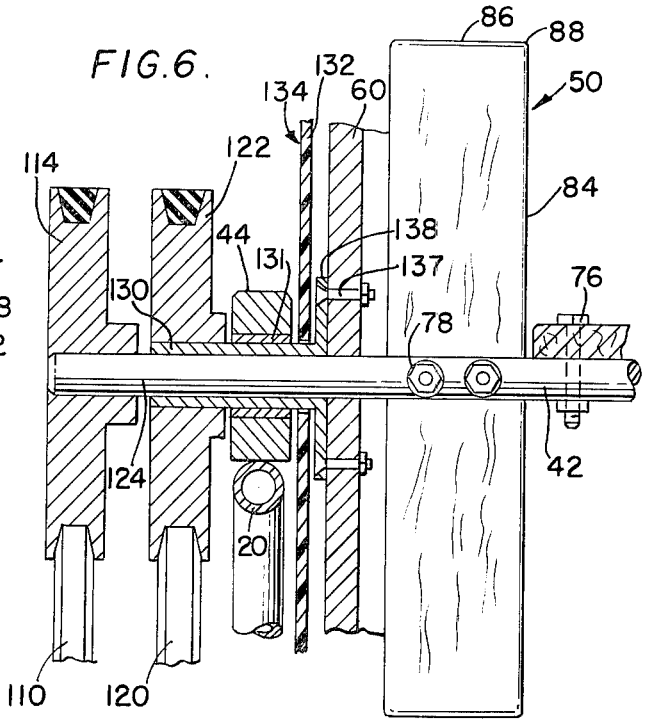
FIG. 6 is a sectional view taken along line 6—6 of FIG. 3.

As shown in FIG. 6, extension 124 of shaft 42 extends outwardly of top element 20 and is fixedly secured to pulley 114 while pulley 122 is fixedly secured to a hub 130 which extends through a journal bearing 131 within keeper means 44 and through end 132 of end 134 of the cover 46 to be connected to end piece 60 of drum 40 by means of bolts 137 fastening radial flange 138 to the drum end piece 60. Therefore, rotation of pulley 114 by belt 110 causes rotation of shaft 42 about its longitudinal axis, and hence, rotation of paddles 50 about the longitudinal axis of the shaft 42. Likewise, rotation of pulley 122 by belt 120 causes rotation of drum 40 because of the fixed connection between pulley 122 and end 60 via hub 130.

The relative size of pulleys 112, 114 and 122 determines the relative rotational velocities of the paddles and the drum. By adjusting either the rotational speed of the motors 90 or the sizes of the pulleys, the relative rotational velocities of the drum and the paddles can be suitably selected. The rotational velocity of the paddles is preferably about 8.25 times the rotational velocity of the drum. Thus, in the preferred embodiment, the drum rotates at 46 r.p.m. and the paddles rotate in the same direction at a velocity of 380 r.p.m. It is here noted that speed of rotation of the paddles and and the drum, or the relationship of speeds therebetween, is critical in that a variation of 6 r.p.m. from the preferred rotational velocity of either the drum or the paddles may cause poor shelling results. If the rotational velocities are held within the 6 r.p.m. limits, it has been found that 97 percent of that product placed in drum 40 is retrievable.

As shown in FIGS. 1, 2 and 5, cover means 46 surrounds drum 40. Preferably, cover means 46 is Plexiglas and comprises a top 140 removably secured to sides 52 at seams 144 and 146. End channels 148 secure the Plexiglas sides 52 to the end plate 132, and end channels 150 secure the Plexiglas cover to the associated end sections 154 of the end plate 134. End channels 156 are positioned on the lower end of the sides 52 around the outlet chute 54 to properly support those sides.

As shown in FIG. 5, outlet chute 54 is defined to be horizontal and located beneath drum 40 to have a longitudinal centerline vertically beneath shaft 42. However, other orientations can be used.

Figure 4:
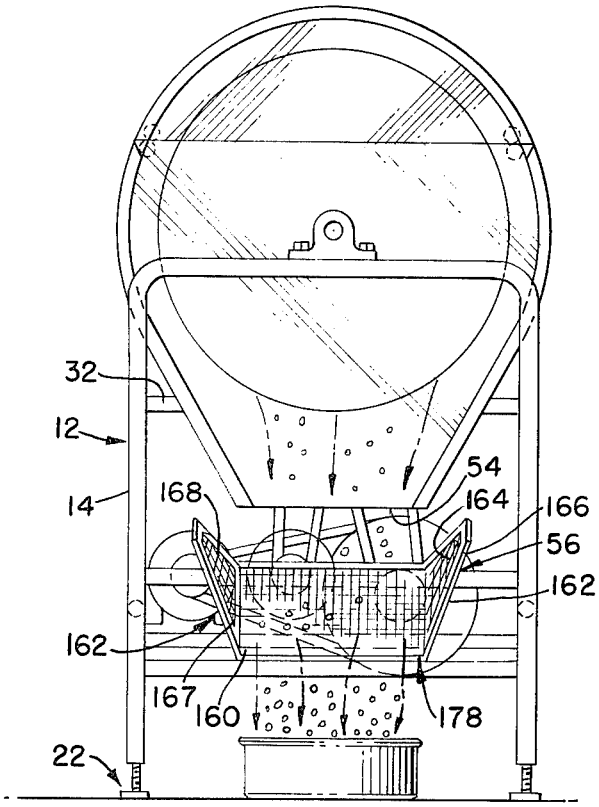
FIG. 4 is an end view showing the other end of the device embodying the present invention.

As shown in FIG. 4, located subadjacent outlet 54 is inclined trough 56 comprising a bottom portion 160 and outwardly inclined side portions 162. The trough is formed of a foraminous screen 164 supported by edge frame elements 166 and longitudinal elements 167. The trough screen has a multiplicity of holes 168 sized and oriented so that kernels falling through foraminous screen 62 of rotating drum 40 are retained within the trough 56. As shown in FIG. 1, the trough extends for the entire length of frame 12 and is supported on transverse cross braces 18 by pivot means 170 and on legs 14 by pivot means 172. Medial rib 174 serves to support the trough screen. The trough 56 has an outlet 178 located on the end of the frame which is remote from the motors 90 and which is located super-adjacent collecting means 58 for guiding kernels thereinto.

Therefore, as shown in FIG. 5, paddles 50 contact product 190 positioned within drum 40 to separate kernels from the pods. Kernels 192 which are separated from the pods pass through holes 70 in screen 62 and enter chute 54 defined by sides 52 of the cover 46 to be guided downwardly into inclined trough 56 and thereby to collecting means 58 via outlet 178. Waste material is retained within drum 40 for later removal therefrom.

The waste material is easily removed from the drum by simply opening the door 64 and operating the drive means 36 to rotate the drum. As the drum rotates, the waste material drops through the open door into trough 56 and from there into a waste material collection means similar to collecting means 58.

It is seen that the beating elements, i.e., the paddles, are mounted to impact the vegetables and drive them in the plane of rotation (as opposed to obliquely of the shaft 42) to deliver thereto a direct impact (as opposed to a glancing impact) thus to throw the material upwardly. There is essentially no axial component of the impeller motion imparted to the material.

As shown in FIG. 1, a partition 196 may be affixed to rotating drum 40 to extend transversely thereof to divide that drum into separate compartments so that smaller loads can be accommodated. The partition may be rotatably secured about shaft 42 for rotation with drum 40. The partition serves to strengthen the drum as well as facilitate the shelling of small loads.

Furthermore, a plurality of screens 62 can be supported on the ends 60 in layered relation to adjust the size of screen holes 70 for various size kernels.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within the metes and bounds of the claims or that form their functional as well as conjointly cooperative equivalents, are therefore intended to be embraced by those claims.

What is claimed is:

1. An apparatus for shelling peas, beans, leguminous vegetables and the like and delivering same in a substantially undamaged condition comprising:

a frame;

a drum rotatably mounted on said frame for receiving peas, beans, leguminous vegetables and the like to be shelled, said drum being cylindrical with a smooth, continuous inner surface which contacts the product being shelled, said drum being mounted to have the longitudinal centerline thereof essentially horizontal;

a shaft mounted on said frame and extending axially through said cylindrical drum along said longitudinal centerline for supporting same;

a plurality of elongate paddles with a substantially equal width throughout, said paddles each being mounted on said shaft for rotation therewith and located in said cylinder to extend radially outward of said shaft from a central mounting portion of said paddles to outer tips on each end of each paddle, said paddle outer tips being located a sufficient distance from said drum inner surface to permit shelled product to pass freely therebetween, each paddle having a flat surface oriented parallel to said longitudinal centerline for substantially the entire length of said paddle from said shaft to the outer tips of said paddle to present a flat striking surface for substantially the entire length thereof from outer tip to outer tip for impacting the peas, beans and the like, said flat striking surfaces of all of said paddles thereby being oriented generally perpendicularly with respect to a tangent to said drum inner surface so that as said drum and paddles are rotated, product is moved from said inner surface toward said paddle flat surfaces in a direction essentially perpendicular to said flat surface so that impact between the product and said flat surface effects a quick gentle removal of the kernels from the hulls with essentially all of the product in said drum being shelled by said impacting;

drum rotating means on said frame for rotating said drum at a first prescribed rotational velocity which is substantially constant;

shaft rotating means on said frame for rotating said shaft and paddles at a second prescribed rotational velocity which is substantially constant and in the same direction as said first prescribed rotational velocity; and means for maintaining said first and second rotational velocities within a predetermined range of said prescribed rotational velocities with said predetermined range being small enough to prevent said kernels from being pulverized, bruised or mutilated on impacting said flat striking surfaces.

2. The apparatus of claim 1 further including a cover mounted on said shaft and surrounding said drum.

3. The apparatus of claim 2 further including means on said drum and means on said cover through which material passes for placement in said drum.

4. The apparatus of claim 3 further including a chute on said cover and located adjacent said drum.

5. The apparatus of claim 4 further including a trough on said frame adjacent said chute.

6. The apparatus of claim 5 further including a collecting means located adjacent said trough for collecting material from said trough.

7. The apparatus of claim 6 further including a foraminous screen mounted on said drum and having a multiplicity of holes which are sized and shaped to pass kernels therethrough while retaining the shells of the material placed in said drum.

8. The apparatus of claim 1 wherein said first rotational velocity is about 46 r.p.m. and said second rotational velocity is about 380 r.p.m.

9. The apparatus of claim 1 wherein said paddles have longitudinal and transverse edges which are gently rounded and which intersect each other at gently rounded corners.

10. The apparatus of claim 9 wherein said paddles are wood.

11. The apparatus of claim 7 further including a partition fixed to said drum and positioned transversely thereof for dividing said drum into at least two separate compartments for shelling small loads of material.

12. The apparatus of claim 1 wherein said first and second rotational velocities are within a range of about 6 r.p.m. of prescribed rotational velocities.

13. The apparatus of claim 1 wherein said second rotational velocity is about 8.25 times said first rotational velocity.

14. The apparatus of claim 1, wherein said drum is closed so that the product does not leave said drum until that product is shelled.

* * * * *